US007066869B2

(12) United States Patent
Cook et al.

(10) Patent No.: US 7,066,869 B2
(45) Date of Patent: Jun. 27, 2006

(54) MACHINE FOR AND METHOD OF SECURING A LINING BAG AT PRECISE LOCATIONS ON THE INNER SURFACE OF A CONTAINER BLANK

(75) Inventors: Matthew R. Cook, Hinsdale, IL (US); Akira Baba, Tokyo (JP)

(73) Assignee: LBP Manufacturing, Inc., Cicero, IL (US)

( * ) Notice: Subject to any disclaimer, the term of this patent is extended or adjusted under 35 U.S.C. 154(b) by 0 days.

(21) Appl. No.: 10/895,506

(22) Filed: Jul. 21, 2004

(65) Prior Publication Data

US 2005/0043157 A1 Feb. 24, 2005

Related U.S. Application Data

(62) Division of application No. 10/386,136, filed on Mar. 11, 2003.

(51) Int. Cl.
*B31B 1/14* (2006.01)

(52) U.S. Cl. ..... 493/69; 493/87; 493/52

(58) Field of Classification Search ..... 493/13, 493/33, 27, 12, 79, 69, 87, 52
See application file for complete search history.

(56) References Cited

U.S. PATENT DOCUMENTS 2,776,224 A * 1/1957 Cote ..... 427/288
3,144,816 A 8/1964 Walker et al.
3,227,322 A 1/1966 Crain
3,363,807 A 1/1968 Powell
3,785,254 A 1/1974 Mann
4,471,884 A 9/1984 Kuchenbecker
4,629,445 A 12/1986 Toriyama
4,658,961 A 4/1987 Tamura
4,930,830 A 6/1990 Toriyama
5,024,478 A 6/1991 Toriyama
5,137,506 A * 8/1992 Haenel et al. ..... 493/417
5,193,712 A 3/1993 Kuppersbusch
5,212,656 A * 5/1993 Clary et al. ..... 702/84
5,281,271 A 1/1994 Govani et al.
5,704,541 A 1/1998 Mogard
5,715,992 A 2/1998 Andrews et al.
5,857,309 A * 1/1999 Cicha et al. ..... 53/167
5,970,682 A * 10/1999 Focke et al. ..... 53/53
5,993,367 A * 11/1999 Hattori et al. ..... 493/12

(Continued)

FOREIGN PATENT DOCUMENTS

EP 1127807 8/2001

(Continued)

*Primary Examiner*—Sameh H. Tawfik
(74) *Attorney, Agent, or Firm*—Brinks Hofer Gilson & Lione

(57) ABSTRACT

An automated machine for and the method of fabricating containers made from a cardboard paperboard or corrugated paperboard blank having an inner liquid holding bag secured to the inner surface of the paperboard box. The liquid holding bag includes a spout that extends through a spout opening formed in the paperboard blank. During the fabrication process the spout is utilized to precisionally locate the liquid holding bag so that when the panel of the blank with the spout opening is folded down over the spout, the spout will be properly aligned with the spout opening thus facilitating the automatic assembly of the container. In this automatic assembly process the liquid holding bag is secured to the inner surface of the container at multiple locations such that when the container is opened into its three dimensional use configuration a passage is opened for filling the bag through the spout.

6 Claims, 8 Drawing Sheets

U.S. PATENT DOCUMENTS 6,053,401 A 4/2000 Andrews, Sr.
6,062,431 A 5/2000 Geshay
6,145,275 A * 11/2000 Sweeney ..... 53/412
6,168,074 B1 1/2001 Petriekis et al.
6,186,493 B1 2/2001 Toriyama
6,228,010 B1 5/2001 Toriyama
6,253,993 B1 7/2001 Lloyd et al.
6,290,124 B1 9/2001 Andrews et al.
6,629,916 B1 * 10/2003 Vijuk et al. ..... 493/81
2002/0047040 A1 4/2002 Andrews, Sr. et al.

FOREIGN PATENT DOCUMENTS

JP 9164609 6/1997

* cited by examiner

MACHINE FOR AND METHOD OF SECURING A LINING BAG AT PRECISE LOCATIONS ON THE INNER SURFACE OF A CONTAINER BLANK

CROSS REFERENCE TO RELATED APPLICATION

The present application is a divisional of U.S. application Ser. No. 10/386,136, filed Mar. 11, 2003, which is incorporated by reference herein.

BACKGROUND OF THE INVENTION

Paperboard containers enclosing flexible liquid impervious beverage bags having a dispensing spout which can also be used for filling the bag have become popular. Containers such as this are used for dispensing beverages such as wine, coffee, beer and soft drinks. Currently the paperboard containers are assembled on automated assembly machines into a flat configuration without the bag which configuration facilitates shipping the containers to the customer. The automated assembly machine receives paperboard blanks that have been die cut and creased. The automated assembly machine re-creases the blank to facilitate easier formation of the container, and crushes a flap on the blank that will be used to glue two side panels of the container together to thus connect the vertical side panels of the container. As the blank progresses along the automated assembly machine glue is applied to the glue flap, panels are folded along preformed creases and two side panels are glued together along the glue flap. Pressure is applied for a sufficient time to allow the glue to set. After the blank has been formed into its flat configuration by the automated assembly machine the bag is manually inserted with its spout extending through a spout opening in a panel of the blank. The customer receives the container in its flat configuration with the spout of the bag protruding from the spout opening. The customer erects the container to its three dimensional configuration and fills the bag through the spout. However, since the container and bag has been assembled and shipped in a flat configuration, the surfaces of the bag sometimes cling together after the container has been erected making it difficult to initiate filling the bag. When this has occurred unsanitary conditions can result if something is inserted into the spout to open a passage way to fill the bag. The step of inserting the bags by hand is labor intensive and adds substantial to the cost of manufacturing. This step is also responsible for an unacceptable high rejection rate. Thus, there is a need for a machine and method for fabricating containers of this type that will automatically place the bag in its proper orientation during the automated assembly of the containers in such a way that the throat of the spout will be open to receive liquid when the carton is erected by the customer.

SUMMARY OF THE INVENTION

The present invention relates in general to a machine and the method for fabricating containers made from cardboard paperboard or corrugated paperboard with an inner liquid holding bag, and, more particularly, to a machine and process for automatically locating the liquid holding bag relative to the inner surface of the cardboard, paperboard or corrugated paperboard blank such that the spout is properly aligned with the spout opening in the blank to facilitate automatic assembly of containers including the liquid holding bag in a flat shipping configuration. In this automatic assembly process the liquid holding bag is secured to the inner surface of the container at multiple locations such that when the container is opened into its three dimensional use configuration a passage is opened for filling the bag through the spout.

BRIEF DESCRIPTION OF THE INVENTION

The bag feeding portion of this invention is fed a pre-manufactured string of flat impervious bags having a spout protruding from a surface thereof. The string of bags are aligned and severed into individual bags. The individual bags are then precisely located such that they can be fed to an automated assembly machine with the spout accurately located relative to the spout hole formed in a container blank that is under the control of the automated assembly machine. The automated assembly machine is modified to detachably secure the bag to the container blank, for example, by fugitive hot melt adhesive commonly referred to as "fugitive glue." Fugitive glue produces exceptional temporary fugitive cohesion and easy release of combined paper and or plastic that can be removed without fiber failure. In the preferred embodiment of this invention two lines of fugitive glue are applied to two side panels of the blank that will be vertical sides of the container when it is erected. The machine of this invention feeds the bag into the assembly line of the automated assembly machine and the outer surfaces of the bag are initially glued by the fugitive glue to a first location on the blank that will be on the inner surface of a container box when it is erected. The automated assembly machine continues its usual process to assemble the container into its flat configuration. In this assembly process of the container cold glue is applied to the under surface of the glue flap and the side panel to which the glue flap is attached is folded over. Fugitive glue is applied to the side panel containing the spout opening, as a result, the surface of the glue flap containing the cold glue is facing up and the panel containing the spout opening has fugitive glue on its surface that will engage the bag. Thus, when the panel of the blank containing the spout opening is folded over, the spout opening and the spout are accurately aligned and as the panel is pressed flat the spout is automatically inserted through the spout opening, the bag is attached to this panel by the fugitive glue and this panel is glued to the panel containing the glue flap. The blank with the bag attached at two locations proceeds down the assembly line of the automated assembly machine in a flat configuration with the edges of the panels that will be the vertical sides of the finished product attached through the glue flap by the cold glue. Pressure is applied to secure the glue joints. The finished product of this carton forming machine is a flat product, suitable for shipping. When this product is received by the consumer it can be erected by hand resulting in a three dimensional container in which the bottom and sided are fully formed and the bag as a result of being connected by fugitive glue to two side panels has been opened such that the spout is open to receive fluid. The top of the container is closed by applying tabs in slots which results in a fully closed box having carrying handles. When the finished product is erected two sides of the bag are pulled away from each other as a result of their being connected by the fugitive glue to different side panels of the container and the throat of the finished product is open and ready to be filled with a liquid through the spout and then capped.

DETAILED DESCRIPTION OF THE INVENTION

Hereinafter, embodiments of the present invention will be described with reference to the accompanying drawings; however, the present invention is not limited to the embodiments described below.

Figure 1:
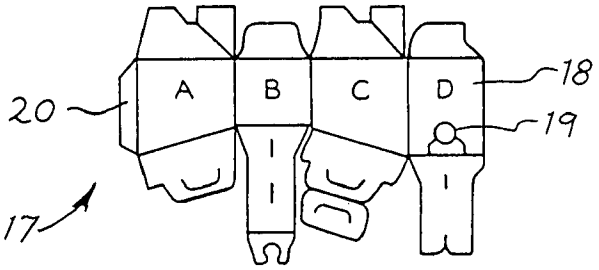
FIG. 1 is a plan view of a flat paperboard blank.

FIG. 1 is an example of the type of blank 17 that is used in the carton forming machine 10 of this invention to produce the final product. A bag 11 of the type shown in FIG. 2, having a spout 16 is secured to a surface of the blank 17 that will become the inner surface of the container that is to be formed by blank 17. The blank 17 can be die cut from cardboard paperboard or corrugated paperboard and is made up of a plurality of connected side panels A, B, C and D that are dimensioned and configured such that the finished product will have four flat panels or sides. The blank 17 also includes top and bottom panels extending from the side panels A, B, C and D. The side panel A has a side edge from which a glue tab 20 extends and side panel D has a free side edge along which the glue tab 20 will be secured by adhesive such as a cold glue. During the production of the blank crease marks are depressed into the cardboard paperboard or corrugated paperboard between adjacent panels to facilitate folding adjacent panels. The side panel D has a spout receiving hole 19 formed therein through which the spout 16 of the bag 11 will protrude. Blank 17 also has a number of self locking slots and tabs that enable the blank to be formed into an enclosed container. The process for manufacturing blanks of this type and for assembling them on automatic machines without a bag secured to the inner surface is well known and is not a part of the invention of this application. The specific configuration of the blank 17 shown in FIG. 1 is an example of the type of blank used in applicants' preferred embodiment of the invention however blanks of other shapes and configurations can be used with the bag feeding portion and method of applicants' invention. Although the preferred embodiment disclosed herein includes four side panels, the invention disclosed herein can be performed using panels having three or more side panels.

Figure 2:
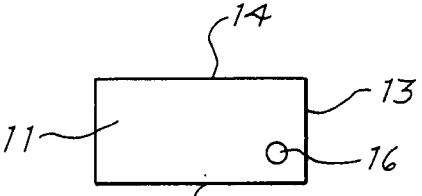
FIG. 2 is a plan view of a flat bag.

FIG. 2 shows a bag 11 of the type that can be used with the bag feeding portion and for performing the method of applicant's invention. As seen in FIG. 2 the bag 11 is rectangular in shape and has an initial leading edge 13, a trailing edge and a pair of longitudinal edges 14 and 15. The bag changes feeding directions during the process and the longitudinal edge 14 becomes the leading edge in the later portion of the process. The bag 11 has upper and lower layers that are joined around the complete periphery. A spout 16 is secured to the layer visible in FIG. 2 and protrudes upwardly there from. During the assembly the bag 11 is secured at multiple locations to the interior surface of the box that is formed when the blank is erected at which time the bag 11 is completely enclosed by the box.

Figure 3:
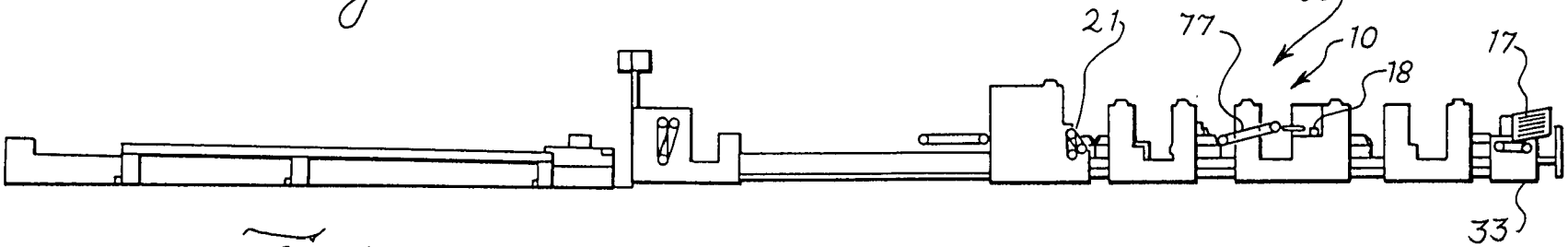
FIG. 3 is a side view of the carton forming machine.
Figure 4:
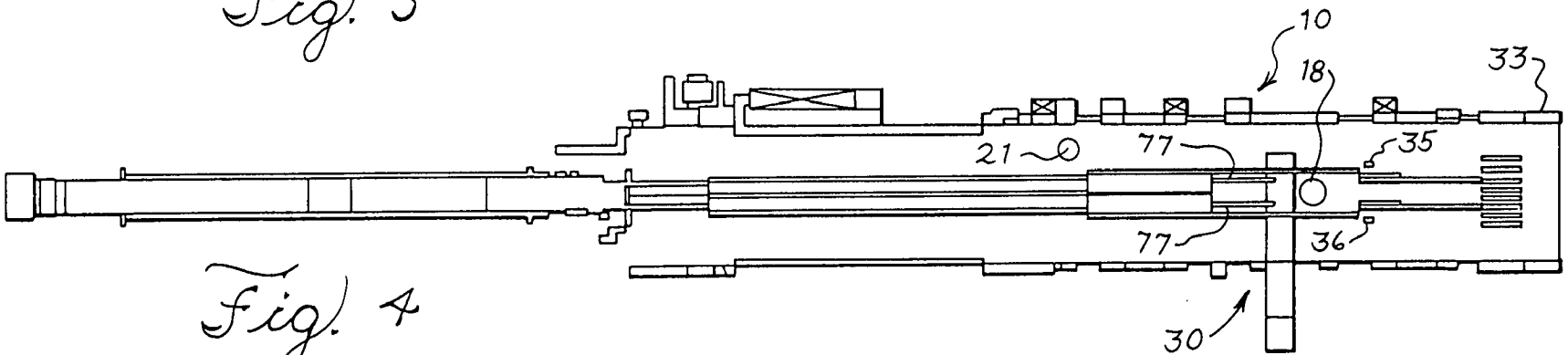
FIG. 4 is a plan view of the carton forming machine.

FIG. 3 is a side view and FIG. 4 a top view of an automatic carton forming machine 10 including applicants' bag feeding portion 30 which has been added as a section of the machine 10. A stack of blanks 17 are provided at the receiving end 33 of the machine 10. Individual blanks are fed from right to left and are re-creased at a re-creaser station 35 and the glue flap 20 is crushed by a glue flap crush roll 36. After blanks 17 commence being fed in the given direction, from right to left as seen in FIGS. 3 and 4, lines of fugitive glue are applied to panel C of the blank by a glue dispenser at a first fugitive glue dispensing station 18. As will be described in greater detail a string of bags 12 are fed into the bag feeding portion 30 and are cut into individual bags 11 and the spouts 16 precisely located. The individual aligned bags 11 are then conveyed by suction conveyor belts 77 that change their direction of feed by 90°. The bags 11 are now being fed in the given direction of feed of the blanks 17. The suction conveyor belts 77, moving in the same direction as the direction of feed of the carton forming machine 10, deposit the bags 11 on the upper surface of the blanks 17. The bags 11 will be detachably secured to the upper or second surface of the blank, for example by fugitive glue that is applied to panels C and D of the blank 17 on the upper or second surface of the blank. The upper or second surface of the blank will be the inner surface of the container when it is erected into its three dimensional state. The bag 11 has been precisely deposited on the blank 17 by the suction conveyor belts 77 such that it does not overlay panel D and when panel D is folded over the spout 16 of the bag 11 is received in the spout receiving hole 19 in panel D. The folding mechanism forces the panel D flat such that a portion of the bag is sandwiched between panel D and panel C that is adjacent to panel D and the spout 16 protrudes upward through the spout receiving hole 19. As the blank 17 progress along the carton forming machine 10 cold glue is applied to the glue tab 20 and tabs that will form the bottom of the erected box at a glue dispensing station 21. Fugitive glue is also applied to the surface of blank D at the glue dispensing station 21. The cold glue is applied to the first surface of the glue tab 20 which surface of the blank 17 will form the outer surface of the container. Fugitive glue is applied to the upwardly exposed surface of panel D at the glue dispensing station 21. The surface of glue tab 20 to which the cold glue has been applied is folded over along with panel A such that the cold glue is facing up and the panel D is folded down over the glue tab 20 to thus attach the first surface of the glue tab 20 to the second surface of panel D, which second surface will be the inner surface of the container. At the same time the surface of panel D having fugitive glue applied thereto is folded over the upper exposed surface of the bag 11. As the folded container progress in the given direction along the carton forming machine 10 pressure is applied to upper surface of the folded container for sufficient time to insure a sound connection of the glued surfaces.

Figure 5:
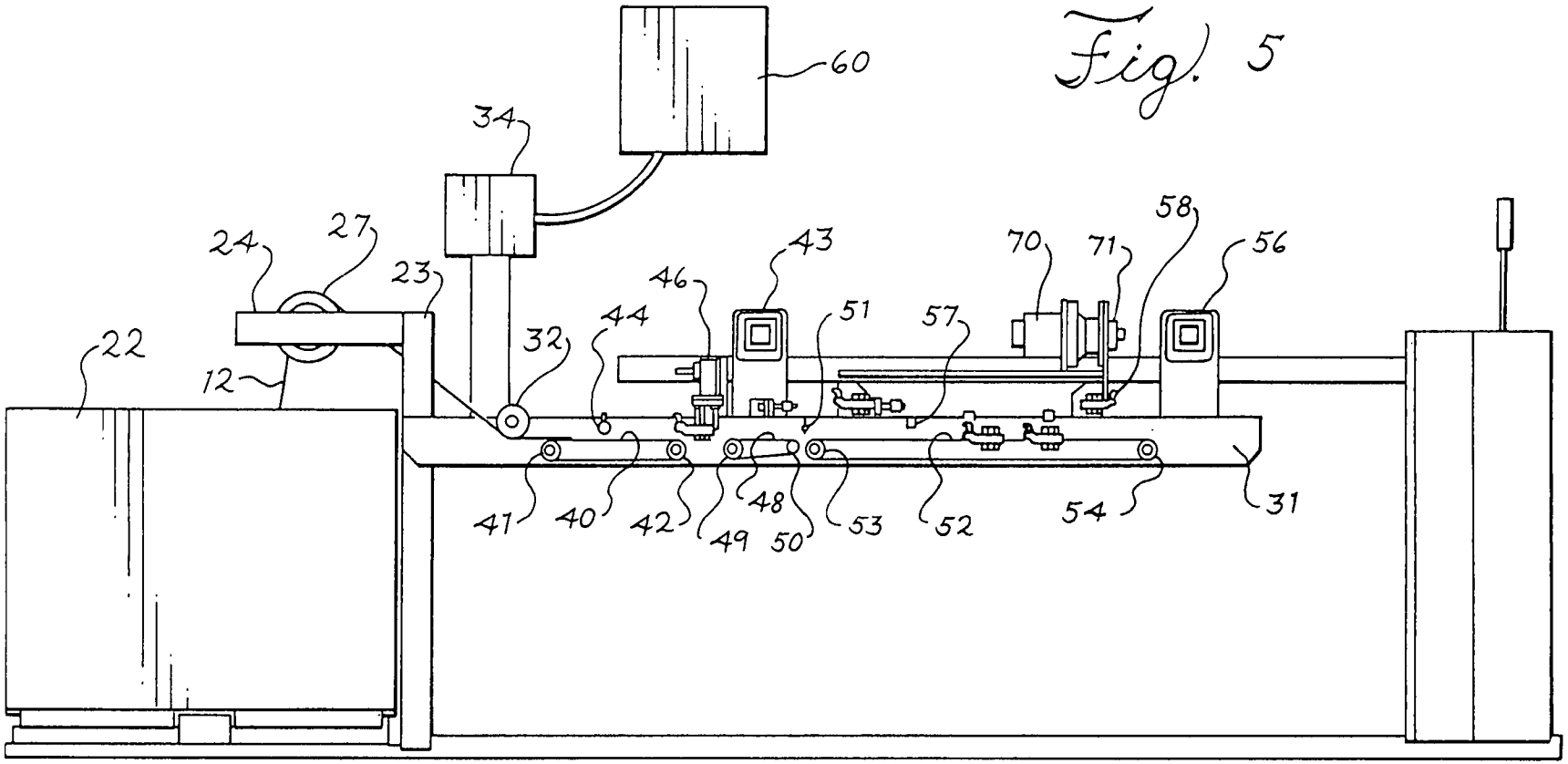
FIG. 5 is a side view of the entire bag feeding portion of the carton forming machine.
Figure 6:
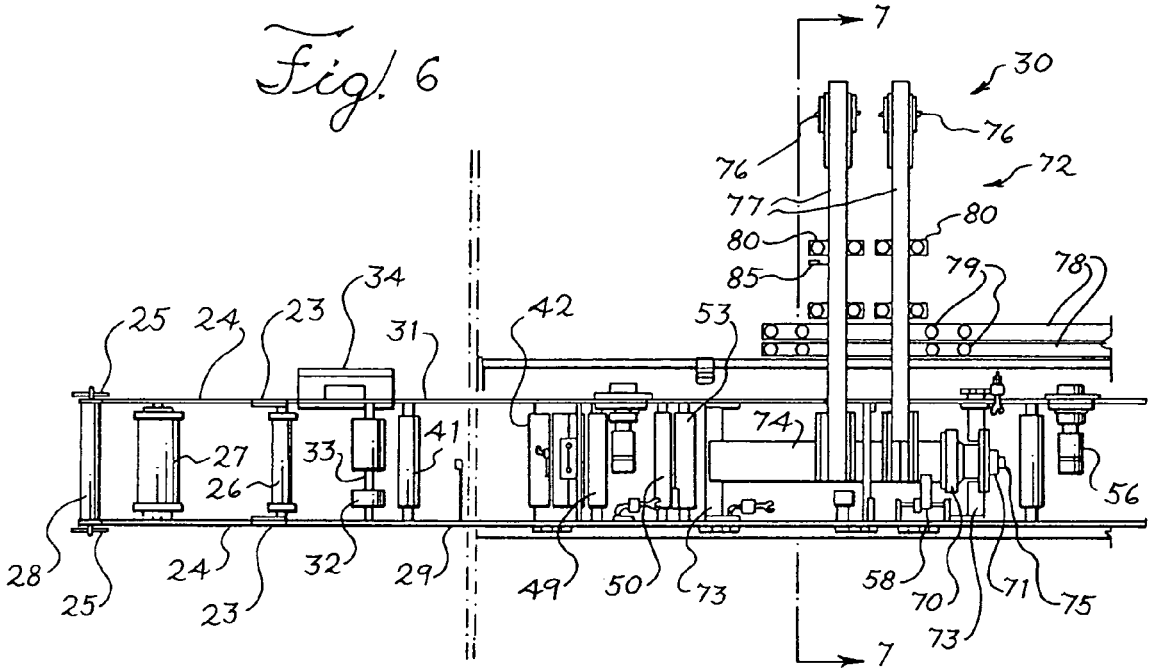
FIG. 6 is a top view of the entire bag feeding portion shown in FIG. 5.
Figure 7:
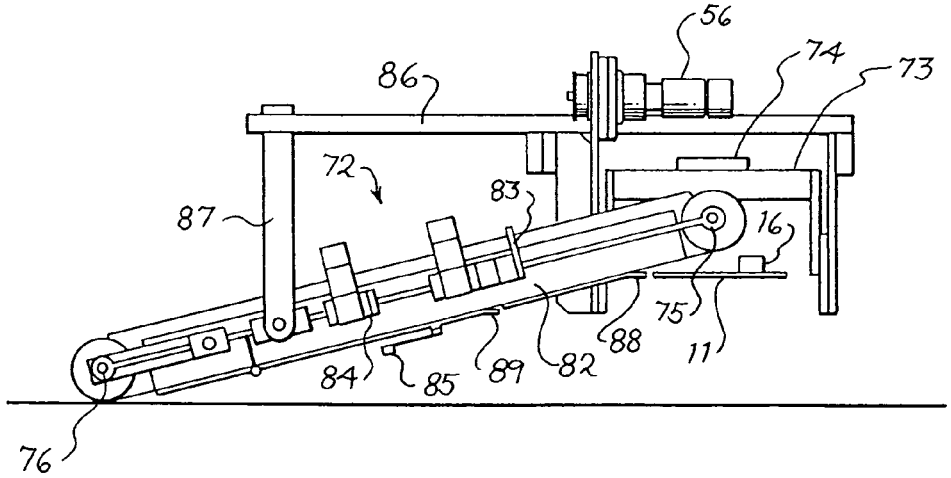
FIG. 7 is a cross sectional view taken along lines 7—7 of FIG. 6.

FIG. 5 is a side view and FIG. 6 a top view of the bag feeding portion 30 of the carton forming machine 10. FIGS. 5 and 6 are of a scale that the complete bag feeding portion 30 is shown in these views, however the scale of these views does not permit the details of all of the components of bag feeding portion to be shown in these views. Thus, an overview of the bag feeding portion with reference to FIGS. 5–7 is provided. It should be noted that in FIG. 5 the frame member 29 has not been shown in order to better show the components that are behind that member. A detailed discussion of the bag feeding portion 30 is provided with reference to FIGS. 6A, 8B, 9A, 9B, 10A and 10B, which are enlarged and more detailed views of the components of bag feeding portion 30.

This machine includes a series of servo motors for driving components, electronically actuated air cylinders for actuating devices and electric eyes for recognizing the presence of objects at certain locations all of which are operatively associated with a Programmable Logic Controller (PLC) 60 that controls the operation of the machine 10 including the bag feeding portion 30.

As seen in FIG. 5 a web or string of interconnected bags 12 is provided in a bag box 22. The string of bags 12 is in the form of a flat ribbon of interconnected bags 11. Each individual bag is rectangular shaped and has a spout 16 protruding from one flat surface. The bag feeding portion 30 is provided with an upright mast 23 having a horizontal arm 24 extending from its upper end. A spool shaped roller 27 is mounted for free rotation on horizontal arm 24. The string of bags 12 extend out of the container and around spool shaped roller 27 as illustrated. The spool shaped roller 27 is sized such that the string of bags 12 fits without binding between the rims of the spool shaped roller 27. The bag feeding portion 30 has parallel horizontally extending frame members 29 and 31. The string of bags 12 is threaded horizontally into the bag feeding portion 30 under a guide roller 32 that is rotatably supported by frame members 29 and 31. The string of bags 12 are orientated such that the spouts 16 of the bags protrude upwardly from the upper flat surface of the bags. As best seen in FIG. 6, roller 32 has a break 33 along its length for accepting the upwardly extending spouts 16. The movement of the bags 12 through the bag feeding portion 30 is controlled by a series of belt conveyors that are driven by servo motors which are controlled by electric eyes. At the entrance end of the bag feeding portion 30 there is an operation board 34 from which an operator can control the threading operation of the bags 12 into the bag feeding portion 30. In the preferred embodiment of the invention the operating board 34 is a touch screen monitor, which is operatively connected to the PLC 60.

After passing below guide roller 32 the string of bags 12 encounters a first belt conveyor 40 that extends over a pair of rollers 41 and 42. Roller 42 is driven by servo motor 43. A second belt conveyor 48 is located downstream of the first belt conveyor 40. Second belt conveyor 48 extends over rollers 49 and 50. Roller 49 is also driven by servo motor 43 and as a result first and second belt conveyors are driven at the same speed. An electric eye 44 is located above first belt conveyor 40 and functions, after the operation has commenced, to sense the presence of the string of bags. If the presence of the bags is not sensed, for example if there has been a break in the string of bags 12, a signal is sent to the PLC 60 and the operation of the carton forming machine 10 is stopped. A cutter mechanism 46, supported by the frame members 29 and 31 is located between the first and second belt conveyors. Cutter 46 functions to sever the leading bag 11 of the string of bags 12 from the trailing string. An electric eye 51 that is located near the discharge end of second belt conveyor 48 senses the presence of the spout 16 on the severed bag 11, and sends a signal to the PLC 60 which is programmed to send a signal to servo motor 43 causing the first and second belt conveyors 40 and 48 to stop to allow severing of the next bag. The PLC 60 also sends a signal to cutter 46 causing its blade to descend and sever the leading bag 11. After a short time delay a signal is sent to servo motor 43 causing the belt conveyors 40 and 48 to be energized. The severed bag 11 is resting on second belt conveyor 48 and when this conveyor is energized it causes the severed bag 11 to shoot forward to be received on a third belt conveyor 52 that extends over rollers 53 and 54. Roller 54 is driven by servo motor 56. An electric eye 57 senses the spout 16 of the severed bag 11 on third belt conveyor 52 and after a timed delay, the conveyor and thus the bag is stopped and a locating device 58 descends into the open spout 16. The locating device is shaped to engage the inner opening of the spout 16 and thus precisely locates the severed bag 11. As will be further discussed air cylinders 93 and 96 function to engage and disengage nip rollers that are when engaged pressed down on the upper surface of the severed bags 12 along their longitudinal edges.

Assuming the machine is operating and the leading individual bag 11 attached to the string of bags 12 has advanced to a point where it is on second conveyor 48. The string of bags 12 was sensed by the electric eye 44 which indicates that the machine is operating properly. Had the electric eye 44 not sensed the presence of a string of bags 12 that would have indicated that the machine is not operating properly and a signal would be sent to the PLC 60 that something was not operating properly and the operation of the machine would be stopped. The spout 16 of the leading bag of the string 12 is sensed by the electric eye 51 indicating that the leading bag of the string of bags 12 is on the second belt conveyor 48. A signal is sent to the PLC which sends a signal to the servo motor 43 that is driving the first 40 and second 48 belt conveyors causing them to stop. After the string of bags 12 has stopped, the PLC sends a signal to the cutter mechanism 46 causing it to descend and cut the leading bag 11 from the string of bags 12. The PLC then sends a signal to servo motor 43 causing it to again drive the first and second conveyors 40 and 48. Since the second conveyor belt 48 has a very light load, a single bag, the severed bag 12 is shot forward to a third belt conveyor 52 that extends over rollers 53 and 54. Roller 54 is driven by servo motor 56.

As the third belt conveyor 52 carries the severed bag 11 forward along the longitudinal length of the bag feeding portion 30 it is sensed by electric eye 57 causing a signal to be sent to the PLC 60 which after a predetermined time interval sends a signal to the servo motor 56 causing the third belt conveyor 52 to stop. The timing causes the spout 16 of the bag 11 to be located below a locating device 58. Locating device 58 includes a frusta conical shaped portion that when lowered into the center of the spout 16, functions to precisely locate the severed bag 11 for subsequent steps in the process. After the bag 11 has been properly located by the locating device 58 the locating device is raised which releases the bag allowing it to be elevated and then grasped by the suction conveyor belts 77 which conveys the bags 11 in a given direction which is 90° from the direction that they were previously moving.

Referring now to FIGS. 6 and 7, the suction conveyor belts 77 that pick up the severed bag 11 from the third belt conveyor 52 are a part of a carriage 72. The carriage 72 carries the bags 11 down to a location over the blank 17 that are moving in the same direction. As the bags 11 merge with the blanks 17 the bags have reached the end of the suction conveyor belts 77 and are thus released there from and are secured to what will become the interior surface of the final product 90.

The carriage 72 is supported, see FIG. 7, by holder arms 86 that are cantilevered from the frames 29 and 31 and carry hanging plates 87 at their free ends. The free ends of the hanging plates 87 are secured to the lower end portion of the carriage 72. A servo motor 70 having a pulley 71 is carried by the frames 29 and 31. A drive belt connects pulley 71 to a pulley (see FIG. 10B) carried by driven shaft 75. Carriage 72 is journalled for rotation on shaft 75. A second shaft 76 is journalled, parallel to shaft 75 at the bottom end of the carriage 72. Two sets of pulleys are carried by the shafts 75 and 76 over which a pair of suction conveyor belts 77 extend. The suction conveyor belts 77 are perforated as illustrated for example by 122 (see FIG. 9B) and the lower rungs of the belts 77 move across the open bottom of vacuum plenums 82. As best seen in FIG. 6, a pair of vacuum ducts 78 that are connected to a vacuum source (not shown) have eight vacuum discharges 79. The carriage 72 has eight hose holders 80 that communicate with the plenums 82, and are connected by flexible air conduits to the corresponding eight vacuum discharges 79 to thus provide a vacuum to the plenums 82. The carriage 72 has two bottom supports 88 and 89 that extend lengthwise of the carriage below the suction conveyor belts 77. The bags 11 are conveyed above the upper surfaces of the bottom supports 88 and 89 and below the lower rung of the suction conveyors belts 77. The carriage has a pair of electric eyes 83 and 84 that are aimed at a reflection plate 85 that function to detect the presence or absence of a passing bag 11.

Figure 8A:
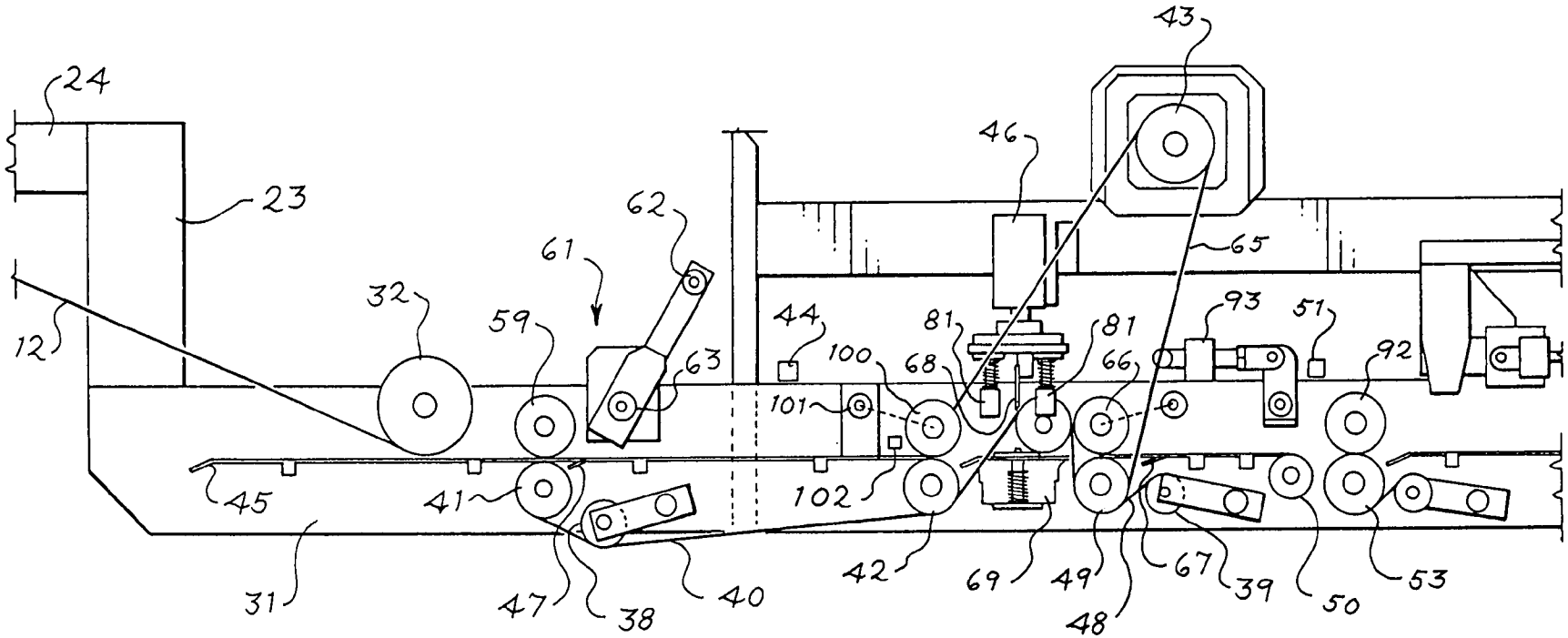
FIG. 8A is an enlarged and more detailed side view, of the left portion, of the side view of the bag feeding portion seen in FIG. 5.
Figure 8B:
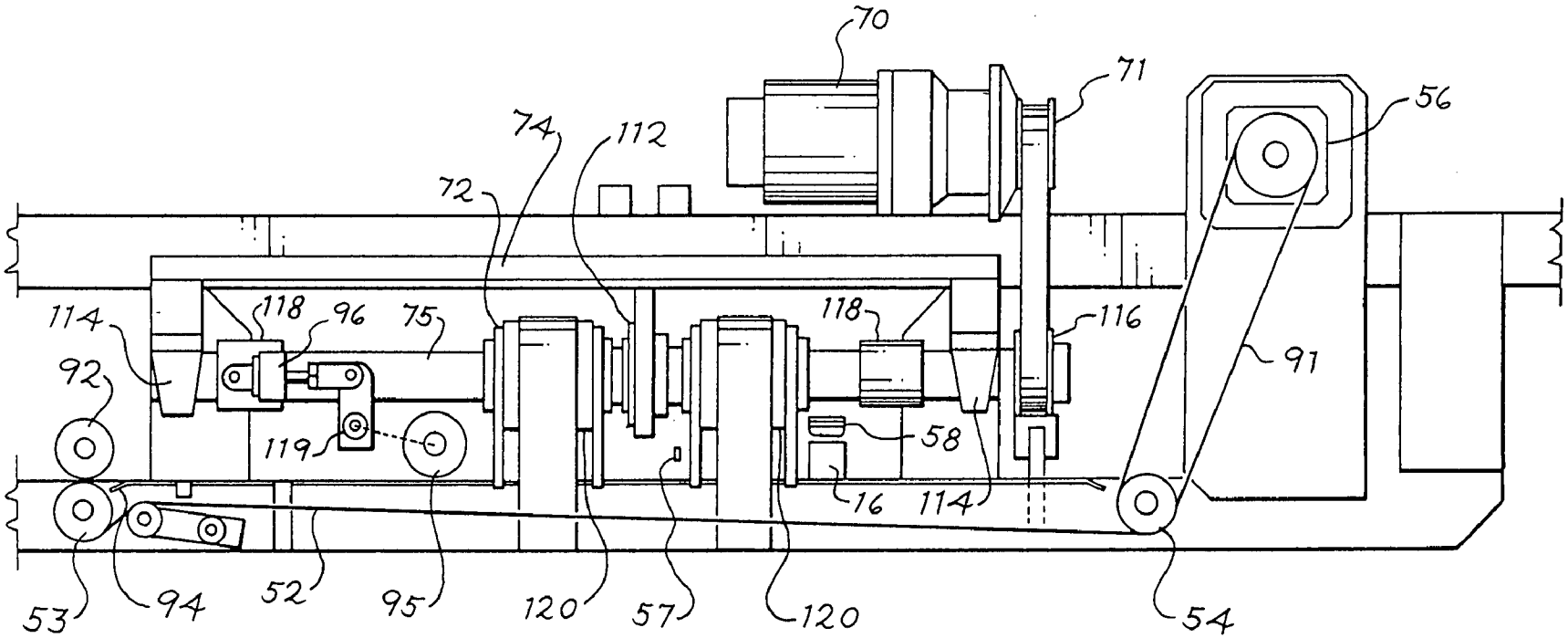
FIG. 8B is an enlarged and more detailed side view, of the right portion, of the side view of the bag feeding portion seen in FIG. 5.
Figure 9A:
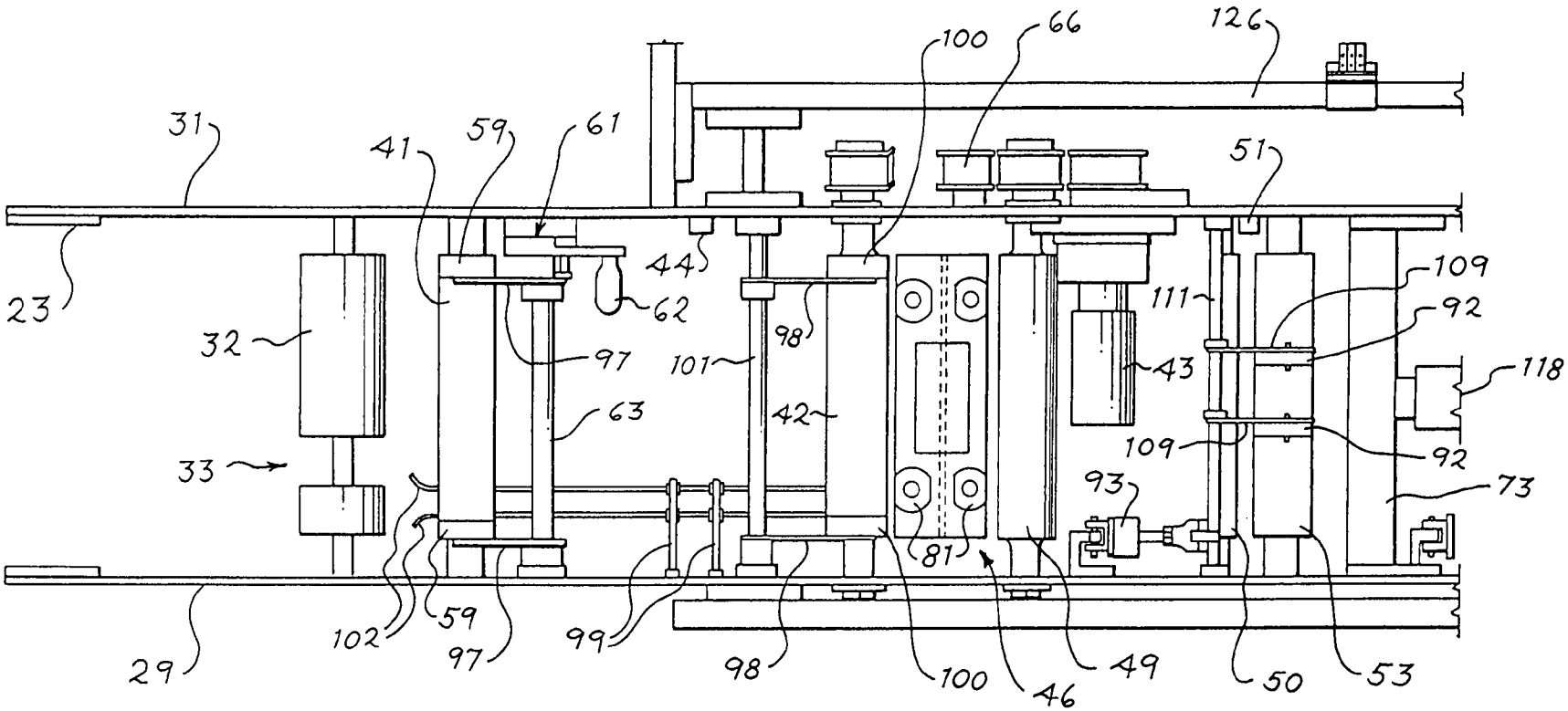
FIG. 9A is an enlarged and more detailed top view, of the left portion, of the top view of the bag feeding portion seen in FIG. 6.
Figure 9B:
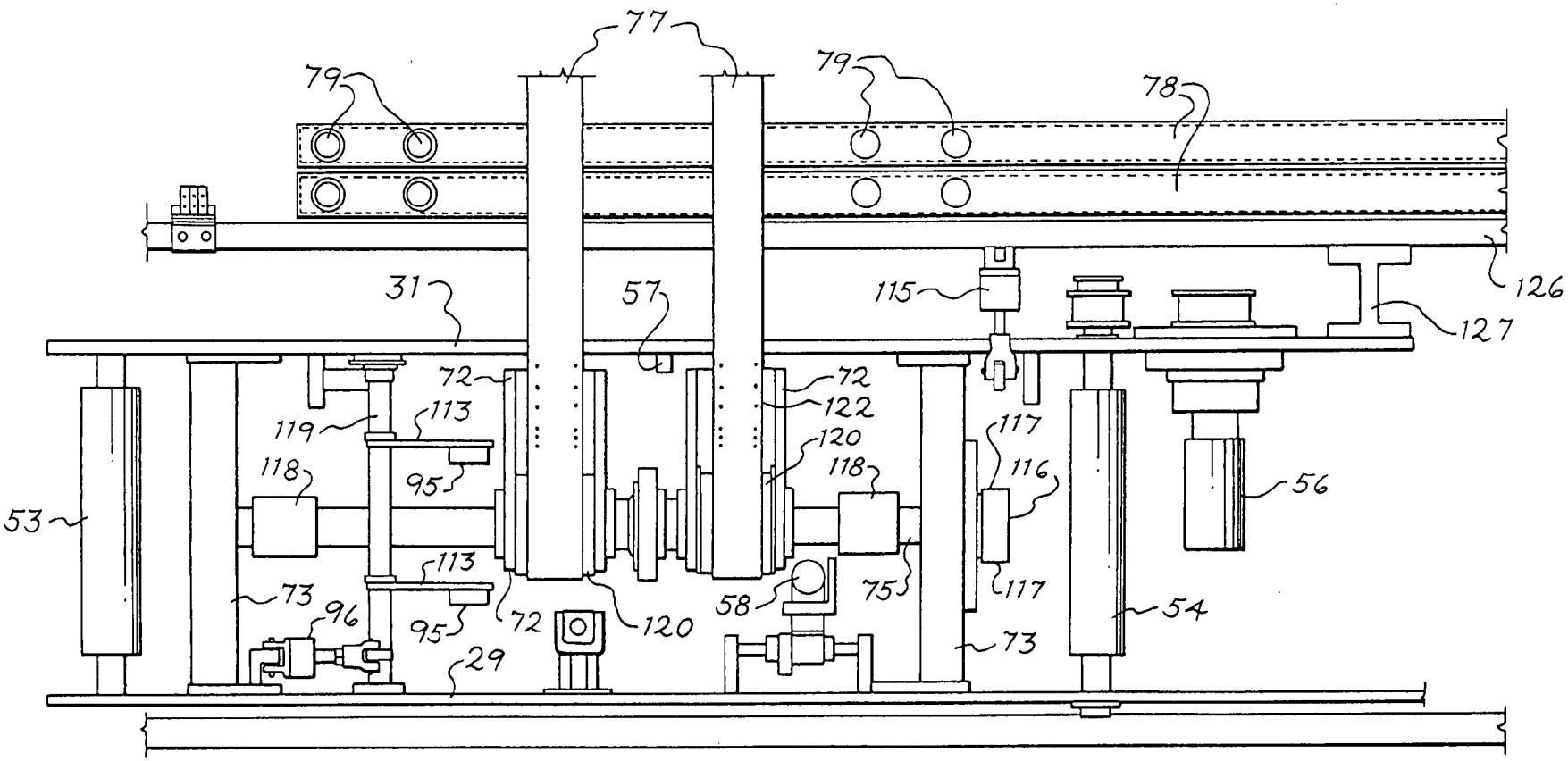
FIG. 9B is an enlarged and more detailed top view, of the right portion, of the top view of the bag feeding portion seen in FIG. 6.

FIG. 8A when combined with FIG. 8B is a side view and FIG. 9A when combined with FIG. 9B is a top view of the bag feeding portion 30 of the carton forming machine 10. FIGS. 8A, 8B, 9A and 9B are similar to FIGS. 5 and 6 but are of a larger scale and thus include details that could not be properly illustrated in FIGS. 5 and 6. The overview discussion of the feeding portion 30 that referenced FIGS. 5 and 6 will be supplemented with the following discussion that refers to FIGS. 8A, 8B, 9A, 9B, 10A and 10B. In plan views FIGS. 6, 9A and 9B the belt conveyors 40, 48 and 52 have not been shown because they would block the view of the underlying components. Conveyors 40, 48 and 52 are shown in FIGS. 5, 8A and 8B.

The bag container box 22 that is shown in FIG. 5 is not included in FIG. 8A since a more detailed discussion of this component and its function is not considered to be necessary or warranted. It should be noted that in FIGS. 8A and 8B the frame member 29 has not been shown in order to better show the components that are behind that member. A detailed discussion of the bag feeding portion 30 is now provided with reference to FIGS. 6A, 8B, 9A, 9B, 10A and 10B.

As seen in FIG. 8A a web or string of interconnected bags 12 is fed into the bag feeding portion from the spool shaped roller 27 that is mounted for rotation on horizontal arm 24 that is carried by mast 23. The string of bags 12 is made up of a plurality of fully constructed bags that are interconnected which facilitates feeding into an automatic processing machine. Each individual bag is rectangular shaped and has a spout 16 protruding from one flat surface. The bag feeding portion 30 has parallel horizontally extending frame members 29 and 31. The string of bags 12 are threaded horizontally into the bag feeding portion 30 under a guide roller 32 that is supported for free rotation by frame members 29 and 31. Guide roller 32 cooperates with an underlying horizontal support surface 45 to guide the string of bags 12 horizontally.

The string of bags 12 are orientated such that the spouts 16 of the bags protrude upwardly from the upper flat surface of the bags. As best seen in FIG. 9A, roller 32 has a break 33 along its length for accepting the upwardly extending spouts 16. The movement of the bags 12 through the bag feeding portion 30 is controlled by a series of belt conveyors that are driven by servo motors which are controlled by the PLC in response to signals received by a series of electric eyes. After passing below guide roller 32 the string of bags 12 encounters a first belt conveyor 40 that extends over a pair of rollers 41 and 42. Roller 42 is driven by servo motor 43. A tensioning member 38 is provided for first belt conveyor 40 that functions to provide proper tension on the first belt conveyor 40. The upper rung of the first belt conveyor 40 is supported by a support surface 47. A pair of nipper rollers 59 overlays roller 41 and functions to insure that the string of bags is moving with the first belt conveyor 40. The nipper rollers 59 are controlled by a manually actuated lever mechanism 61 having a pivot shaft 63 and a handle 62. The nipper rollers 59 are carried by the free ends of links 97 (see FIG. 9A) that extend from pivot shaft 63. The downward pressure of nipper rollers 59 can be adjusted by locking the roller 59 in a selected position. Also the nipper roller 59 can be released and raised to facilitate threading the string of bags 12 into the machine at initial startup or to clear a jam in the system.

A pair of nipper wheels 100 are carried by the free ends of links 98 (see FIG. 9A) that extend from a pivoted shaft 101. Nipper wheels 100 overlay the roller 42 and function to provide positive control of the string of bags 12.

As seen in FIG. 9A a spout guide 102 is located adjacent one of the nipper rollers 59 that functions to receive the spout 16 and properly align the string of bags 12 as it approaches the cutter mechanism 46. The spout guide 102 is carried by frame 29 through mounting arms 99.

An electric eye 44 is located above first belt conveyor 40 and functions, after the operation has commenced, to sense the presence of the string of bags. If the presence of the bags is not sensed, for example if there has been a break in the string of bags 12, a signal is sent to the PLC 60 and the operation of the carton forming machine 10 is stopped.

The second belt conveyor 48 is located downstream of the first belt conveyor 40. Second belt conveyor 48 extends over rollers 49 and 50 and includes a tensioning member 39. The upper rung of the second belt conveyor 48 is supported by a support surface 67. Roller 49 is also driven by servo motor 43 and as a result first and second belt conveyors are driven at the same speed.

The conveyor rollers 42 and 49 are driven by servo motor 43 by a belt 65 that extends over pulleys carried by servo motor 43, rollers 42 and 49 and a freely rotating pulley 66 that is aligned with the other pulleys carried by motor 43 and rollers 42 and 49. These pulleys are seen in FIG. 9A and are located on the far surface of frame member 31 as seen in FIG. 8A. As a result of this drive arrangement first belt conveyor 40 and second belt conveyor 48 are driven in the same direction at the same speed and are stopped and started concurrently.

A cutter mechanism 46, supported by the frame members 29 and 31 is located between the first and second belt conveyors 40 and 48. As will be further discussed the servo motor 43 receives a signal from the PLC stopping the drive to the belt conveyors 40 and 48 such that that the area between bags in the string of bags 12 that must be severed is directly beneath the transversely extending blade 68. Cutter 46 includes a blade 68 that extends transversely to the direction of flow of the string of bags 12 and functions to sever the leading bag 11 of the string of bags 12 from the trailing string. The string of bags 12 has preformed perforated lines between the individual bags 11 and the edge of blade 68 is rounded rather than a sharp edge. Thus, the blade 68 functions to separate the leading bag from the string along the perforated line.

It should be noted that the proper separation of the leading bag from the string of bags 12 depends upon the proper location of the string of bags 12 under the cutter blade 68. As best seen in FIG. 8A there is a cutting table 69 that is spring loaded to allow vertical movement. The cutter 46 includes spring mounted plungers 81 fore and aft of the blade 68. When the cutter 46 is energized the blade 68 and plungers 81 descend. The plungers 81 engage the string of bags before the blade 68 and hold the bag 11 being severed from the string of bags 12 as well as the next bag to be severed from the string of bags 12 against the cutting table 69 as the blade 68 separates bag 11 from the string of bags 12.

An electric eye 51 that is located near the discharge end of second belt conveyor 48 senses the presence of the spout 16 on a severed bag 11 when it is discharged from the second belt conveyor 48. The PLC 60 utilizes this information to calculate when to next stop the drive by servo motor 43 stopping belt conveyors 40 and 48 and when to next energize the cutter mechanism 46.

After a short time delay, to allow separation of bag 11, a signal is sent to servo motor 43 causing the belt conveyors 40 and 48 to be driven. The severed bag 11 is resting on second belt conveyor 48 and when this conveyor is energized it causes the severed bag 11 to shoot forward and it is received on a third belt conveyor 52 that extends over rollers 53 and 54. The upper rung of the third belt conveyor 52 is supported by a support surface 94.

A set of nipper wheels 92 carried at the free ends of levers 109 overlay roller 53. Nipper wheels 92 can be raised and lowered by actuating an air cylinder 93 that rotates pivot shaft 111 from which the levers 109 extend. Energization of air cylinder 93 is under the control of the PLC 60. When the signal is given to energize servo motor 43 causing the severed bag 11 to be transferred from second conveyor 48 to the third conveyor 52 a signal is also sent to air cylinder 93 causing nipper wheels 92 to be raised momentarily to allow the severed bag 11 to be received on the third conveyor 52 beneath nipper wheels 92 which are then lowered on the severed bag 11 to control the conveyance of the bag along third conveyor 52.

It should be noted that the receiving end of third belt conveyor 52 including its roller 53 is shown in FIGS. 8A and 9A and the entire third belt conveyor 52 including both rollers 53 and 54 is shown in FIGS. 8B and 9B. As best seen in FIG. 8B roller 54 is driven by servo motor 56 through belt 91.

Another set of nipper wheels 95 carried on the free ends of levers 113 that extend from a pivot shaft 119. Nipper wheels 95, which function to insure the continued conveyance of the bag along the third belt conveyor 52, can be raised and lowered through a mechanism operated by an air cylinder 96. Energization of air cylinder 96 is under the control of the PLC 60.

As the third belt conveyor 52 carries the severed bag 11 forward along the longitudinal length of the bag feeding portion 30 it is sensed by an electric eye 57 causing a signal to be sent to the PLC 60 which after a predetermined time interval sends a signal to the servo motor 56 causing the third belt conveyor 52 to stop. The predetermined time interval is such that the spout 16 of the bag 11 is stopped below a locating device 58. Locating device 58 includes a frusta conical shaped portion that when lowered into the center of the spout 16, functions to precisely located the severed bag 11 for subsequent steps in the process. After the bag 11 has been properly located by the locating device 58 the locating device is raised which releases the bag allowing it to be elevated and then grasped by the suction conveyor belts 77 which conveys the bags 11 in a direction 90° from the direction that they were previously moving.

Figure 10A:
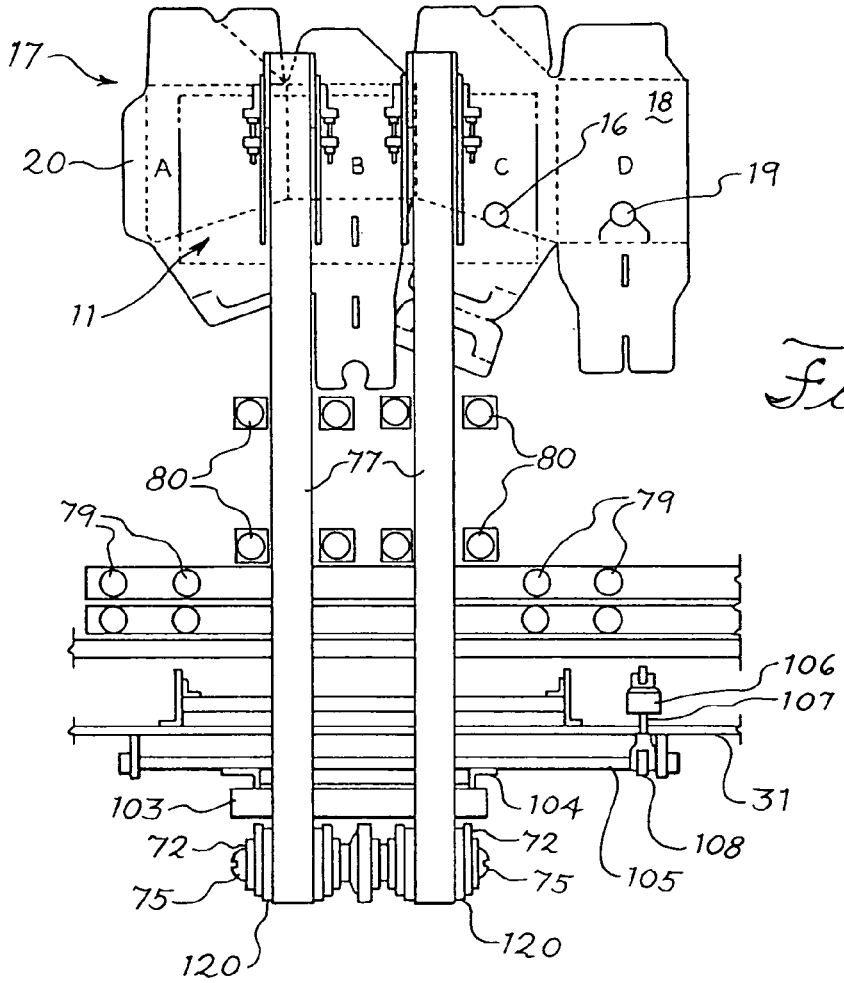
FIG. 10A is an enlarged and more detailed top view, of the upper right portion, of the top view of the bag feeding portion seen in FIG. 6.
Figure 10B:
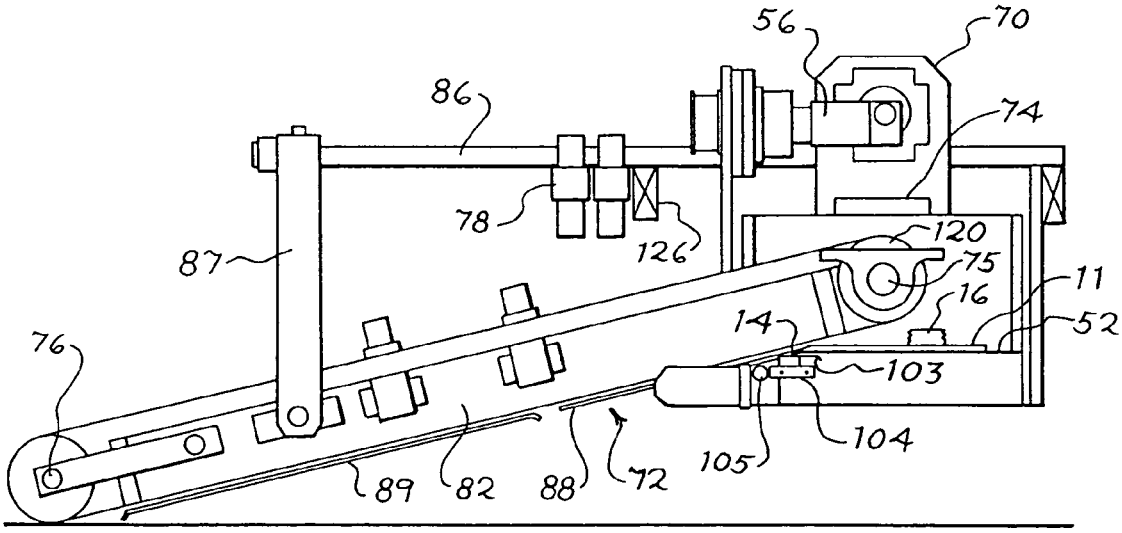
FIG. 10B is an enlarged and more detailed side view, of the upper right portion, of the top view of the bag feeding portion seen in FIG. 6.

The mechanism for raising the bag 11 is illustrated in FIGS. 10A and 10B. A bag 11 is shown in FIG. 10B on conveyor surface 52 after the locating device 58 has been raised. The free edge of a press plate 103 is located below a longitudinal edge 14 of bag 11. The press plate 103 is carried by a lever arm 104 that is secured to a pivot shaft 105. When pivot shaft 105 pivots in a counterclockwise direction, as seen in FIG. 10B, the press plate 103 engages the under surface of bag 11 and elevates the longitudinal edge 14 such that it will be engaged by the suction conveyor belts 77 that overlay the bag 11. As best seen in FIG. 10A a rod 107 of an air cylinder 106, that carried by frame 31, is pivotally connected to a lever arm 108 that extents from pivot shaft 105. When air cylinder 106 is energized causing rod 107 to extend, pivot shaft 105 is rotated causing press plate 103 to be elevated and raise the longitudinal edge 14 of the bag 11 such that it will be grasped by the suction conveyor belts 77. At this time the direction of movement of the bag is changed 90° such that the longitudinal edge 14 that has been raised is now the leading edge of the bag 11 as it is conveyed by the conveyor belts 77.

The suction conveyor belts 77, that picks up the severed bag 11 from the third belt conveyor 52, are a part of a downwardly sloping carriage 72. Carriage 72 is pivotally supported at its upper end on a shaft 75. Carriage 72 can be raised and lowered about its pivot support by the actuation of air cylinder 115 that is seen in FIG. 9B. Shaft 75 is supported for rotation by a central bearing 112 and a pair of end bearings 114. (See FIG. 8B) As best seen in FIG. 8B the right end of shaft 75 has a pulley 116 secured thereto. Rotary drive is provided to shaft 75 by servo motor 70 that has an output pulley 71 that is connected to pulley 116 by a belt 117. The servo motor 70 and pulley 71, shown in FIG. 6, has been omitted from FIG. 9B in order to show pulley 116 connected to shaft 75 in this Figure. Pulley 71 is connected to pulley 116 by belt 117 to thus provide drive to shaft 75. The shaft 75 has a pair of couplings 118 to facilitate assembly and repair. Shaft 75 has a pair of pulleys 120 that function to drive the suction conveyor belts 77. In the preferred embodiment the suction conveyor belts 77 have four sets of perforations identified as 122 one set of which is shown in FIG. 9B. Each set of perforations 122 include three pairs of closely spaced openings that that are located directly above the longitudinal edge 14 of the bag that is raised by the press plate 103. Each set of perforations 122 also includes three pairs of openings that are spaced further apart and function to grasp the surface of the bag following its leading edge 14 that was grasped by the three closely spaced openings. The drive to suction conveyor belts 77 is timed and controlled by the PLC 60 such that the belts are stopped with the three pairs of closely spaced openings over the press plate 103 and begins moving immediately after the leading edge of the bag 11 has been elevated.

A longitudinal extending support 126 is secured to the outer surface of frame 31 by a pair of beams 127. (See FIGS. 9A and 9B) A pair of vacuum ducts 78, carried by support 126, that are connected to a vacuum source (not shown) have eight vacuum discharges 79 that are connected to and provide a vacuum to plenum 82.

Referring now to FIG. 10A which is an enlarged and more detailed top view, of the upper right portion, of the top view of the bag feeding portion seen in FIG. 6 and FIG. 10B which is an enlarged and more detailed side view, of the upper right portion, of the top view of the bag feeding portion seen in FIG. 7.

The carriage 72 is pivotally supported, see FIG. 10B, on shaft 75 at its upper end and by holder arms 86, which are cantilevered from the frame 31, at their lower or free end. Hanging plates 87 are adjustably connected to the holder arms 86 and extending downwardly there from. The free ends of the hanging plates 87 are secured to the lower end portion of the carriage 72. A servo motor 70 having a pulley 71 is carried by the frame 31. A drive belt 117 connects pulley 71 to a pulley (see FIG. 8B) carried by driven shaft 75. Carriage 72 is journalled for rotation on shaft 75. A second shaft 76 is journalled, parallel to shaft 75 at the bottom end of the carriage 72. A pair of pulleys 120 are carried by the shafts 75 over which the pair of suction conveyor belts 77 extend. There is a corresponding pair of pulleys 124 at the free end of the carriage 72 over which the pair of suction conveyor belts 77 also extend. The suction conveyor belts 77 include four sets of perforations as illustrated at 122 in FIG. 9B spaced along their lengths. The conveyor belts 77 travel around a vacuum plenum 82 that is open on its lower surface. The lower rung of the conveyor belts 77 functions as the bottom surface of the vacuum plenum 82 to thus provide vacuum to the perforations 122. A support 126 mounted on the frame 31 carries a pair of vacuum ducts 78 that are connected to a vacuum source (not shown). The vacuum ducts 78 have eight vacuum discharges 79.

The carriage 72 has eight hose holders 80 that communicate with the plenums 82. Hose holders 80 are connected by flexible air conduits to the corresponding eight vacuum discharges 79 to thus provide a vacuum to the plenums 82. The carriage 72 has two bottom supports 88 and 89 that extend lengthwise of the carriage below the suction conveyor belts 77. The bags 11 are conveyed above the upper surfaces of the bottom supports 88 and 89 and below the lower rung of the suction conveyors belts 77.

The carriage 72 carries the bags 11 down to a location over a blank 17 that is moving in the same direction. As the bags 11 merge with the blanks 17 the bags have reached the end of the suction conveyor belts 77 and are thus released there from and are secured to what will become the interior surface of the finished product 90.

The carton forming machine 10 processes the blanks 17 as they are fed in the same direction as the bags 11 are fed by carriage 72. Before the blank 17 reaches the point at which the bag 11 is deposited by carriage 72 on the blank 17 a releasable or fugitive glue is applied to panel C of blank 17. In the preferred embodiment of this invention two lines of fugitive glue 110 are applied to panel C of the blank that is below the spout 16 of the flat bag 11. Additional lines of fugitive glue 110 are applied to the panel D of the blank 17 that has the spout receiving hole 19 formed therein at a later stage of forming the container. The carriage 72 feeds the bag into the processing line of the carton forming machine 10 and deposits it such that the bottom outer surfaces of the bag 11 is glued by the fugitive glue to panel C of the blank that is under the spout 16. After the bag 11 is deposited on the blank 17 the carton forming machine applies cold glue to the under surface of the glue tab 20. This operation can be performed by utilizing a glue wheel that is located below the blank. The lower portion of the glue wheel rotates through a glue reservoir, picking up glue on the periphery of the wheel and transferring it to the underside of the glue flap. This is a type of glue that need not be heated and is referred to as a cold glue. Cold glue is also applied to the flaps of the panel that will form the bottom of the carton such that when the panel is erected the bottom of the carton is fully formed. These are well known processes used in the formation of cartons and are not a part of this invention. After the bag 11 is attached to the blank 17 the carton forming machine will continue its normal processing of the blank. The panel of the blank to which the glue tab 20 is attached will be folded up and then folded flat over adjacent panel B. The glue tab 20 will extend beyond the adjacent panel B and will lay flat over panel C that is supporting the portion of the bag having the spout 16 projecting upwardly there from. The cold glue that has been applied to the glue tab 20 will be facing up. As a result of precisely aligning the bag 11 prior to its deposit on the blank 17, when the panel D is folded flat the spout 16 is aligned with the spout receiving hole 19 formed in the panel D. As the blank 17 continues its normal process along the carton forming machine fugitive glue is applied to the surface of panel D. When the panel D is folded over the spout 16 is forced through the spout receiving hold 19 and this panel is glued to the surface of the bag 11 from which the spout projects. As pressure is applied to flatten the panel D the spout 16 is forced through the spout receiving hole 19 and the edge of panel D is pressed into contact with the cold glue on the glue tab 20. The folded blank with the attached bag 11 proceeds down the carton forming machine 10 while pressure is being applied over the cold glue area for a sufficient time to insure a sound connection of the panel edges. The product is shipped to the consumers in the flat state or flat configuration. When the consumer erects the carton into its three dimensional state the surfaces of the bag 11 that are secured by fugitive glue to the interior surface of the carton cause the surfaces of the bag adjacent to where the spout is connected to be pulled away from each other to insure that the spout is open and free to receive liquid. This facilitates filling the final product 90 with liquid through the spout 16 without the need to insert a foreign object into the spout to open a passage to receive the fluid.

While the invention has heretofore been described in detail with particular reference to illustrations of the bag feeding portion, it is to be understood that variations, modifications and the use of equivalent mechanisms can be effected without departing from the scope of this invention. It is, therefore, intended that such changes and modifications be covered by the following claims.

It is intended that the accompanying Drawings and foregoing detailed description is to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

The invention claimed is:

1. A method of producing a container, from a flat blank having a spout receiving opening formed therein and a flat bag having a spout secured to and protruding there, that can be rapidly erected from a flat state to a three dimensional state at which three dimensional state it facilitates reception, containment and dispensing of fluid, the method comprising:

a step of feeding said flatbags by providing a first bag feeding mechanism;

a step of precisely locating the position of said flat bags on said bag feeding mechanism by providing a spout locating device a step of feeding said flat blank in a given direction by providing a blank feeding mechanism a step of depositing a first fugitive glue deposit on said flat blanks by providing a first glue dispensing mechanism a step of feeding said flat bag in said given direction by providing a second bag feeding mechanism and depositing said flat bag on said flat blanks over said first fugitive glue deposit such that the bag covers a portion of said blank;

after said flat bag is deposited on said flat blank, a step of depositing a second fugitive glue deposit on a portion of said flat blank that is not covered by said bag by providing a second glue dispensing mechanism; and a step of folding said flatblank over said flat bag by providing blank folding mechanism such that said spout is inserted through said spout receiving opening and the bag is secured to said blank by said second fugitive glue deposit.

2. The method of producing a container as set forth in claim 1, comprising the additional step of:

a step of sensing the presence or absence of a string of bays on said first bag feeding mechanism by providing a first electric eye.

3. The method of producing a container as set forth in claim 2 including the following additional step:

a step of controlling and coordinating the first and second bag feeding mechanism by providing a programmable logic controller (PLC), blank feeding mechanism, first and second glue dispensing mechanisms, the blank folding mechanism and the electric eye.

4. The method of producing a container as set forth in claim 1, comprising the additional step of:

a step of sensing the location of said flat bags along said first bag feeding mechanism by providing a second electric eye.

5. The method of producing a container as set forth in claim 4 including the following additional step:

a step of controlling and coordinating the first and second bag feeding mechanism by providing a programmable logic controller (PLC), blank feeding mechanism, first and second glue dispensing mechanisms, the blank folding mechanism and the electric eye.

6. The method of producing a container as set forth in claim 1 including the following additional step:

a step of controlling and coordinating the first and second bag feeding mechanism by providing a programmable logic controller (PLC), blank feeding mechanism, first and second glue dispensing mechanisms and the blank folding mechanism.

* * * * *

UNITED STATES PATENT AND TRADEMARK OFFICE

CERTIFICATE OF CORRECTION

PATENT NO. : 7,066,869 B2
APPLICATION NO. : 10/895506
DATED : June 27, 2006
INVENTOR(S) : Matthew R. Cook et al.

It is certified that error appears in the above-identified patent and that said Letters Patent is hereby corrected as shown below:

Column 14, in claim 3, line 4, after "bag feeding" delete "mechanism" and substitute --mechanisms--.

Signed and Sealed this

Twenty-sixth Day of December, 2006

JON W. DUDAS
*Director of the United States Patent and Trademark Office*